US005883570A

United States Patent [19]

Lusareta et al.

[11] Patent Number: 5,883,570

[45] Date of Patent: Mar. 16, 1999

[54] DECORATIVE DOOR BELL ACTUATOR

[75] Inventors: Donald W. Lusareta, Russellville, Ark.; Muffet S. Frische; Eric A. Frische, both of Plano, Tex.

[73] Assignee: ED Ventions, Inc., Plano, Tex.

[21] Appl. No.: 851,660

[22] Filed: May 6, 1997

[51] Int. Cl.[6] ..... G08B 27/00

[52] U.S. Cl. ..... 340/384.7; 340/326; 340/330; 340/393.3; 340/693.9; 116/279

[58] Field of Search ..... 340/326, 330, 340/384.1, 384.7, 392.1, 393.3, 396.1, 693.5, 693.9; 116/200, 279, 148, 172

[56] References Cited

U.S. PATENT DOCUMENTS

| | | | |
|---|---|---|---|
| D. 339,760 | 9/1993 | Lucero et al. | D10/118 |
| 4,488,024 | 12/1984 | Colgate | 200/330 |
| 5,521,578 | 5/1996 | DelValle | 340/326 |
| 5,570,083 | 10/1996 | Johnson | 340/326 |
| 5,594,409 | 1/1997 | Shank | 340/326 |
| 5,673,016 | 9/1997 | Lutes | 340/330 |
| 5,774,039 | 6/1998 | Housley | 340/326 |

*Primary Examiner*—Edward Lefkowitz
*Attorney, Agent, or Firm*—John E. Vandigriff

[57] ABSTRACT

The invention is a decorative cover/actuator which can be used as a stand alone device or in combination with a door bell. The cover is pivotally mounted on a surface with an adjustable lever extending out the back of the cover. When the cover is pressed toward the wall, the push lever rings the door bell and actuates an electronic circuit inside the cover that can display lights, emit sounds, including music and voice, and cause movable objects on the cover to move.

13 Claims, 6 Drawing Sheets

DECORATIVE DOOR BELL ACTUATOR

FIELD OF THE INVENTION

The invention is to an actuator, and more particularly to an actuator that is used alone or that is used in conjunction with an other actuator such as a door bell button actuator, the actuator may be in the form of a theme object which includes features such as sound, light and motion.

BACKGROUND OF THE INVENTION

Door bells are usually actuated by a single button that, when pushed, closes an electrical switch which connects power to the door bell ringer or chimes. Various door bell designs have incorporated features in addition to the door bell. U.S. Pat. No. 4,414,877 describes a musical chime device.

U.S. Pat. No. 5,564,294 is a musical door lock wherein an electric door bell is incorporated into the door lock. The "door bell" sound may be of the sound of bird chirps.

U.S. Pat. No. 4,833,454 describes a door chime that includes an advertising display.

Each of the above door bell devices have additional features that are incorporated into the door bell, and are actuated when the door bell button is directly pushed, but none are actuated indirectly by an intervening actuator that is used to push the door bell switch and activate other features such as sound, lights, and motion.

SUMMARY OF THE INVENTION

The invention is a decorative cover/actuator which can be used as a stand alone device or in combination with a door bell. The cover is mounted on a wall or flat surface with an adjustable lever for actuating a switch in the actuator. When the cover is pressed toward the wall, the adjustable lever rings the door bell and actuates an electronic circuit inside the cover that can display lights, emit sounds, including music and voice, and cause movable objects on the cover to move. The cover can be of any theme or design. The electronic control circuit, as well as a speaker, activation switch and battery is mounted inside of, or on the back of the cover. The electronic control may control light, sound and motion features.

DESCRIPTION OF A PREFERRED EMBODIMENT

Figure 1:
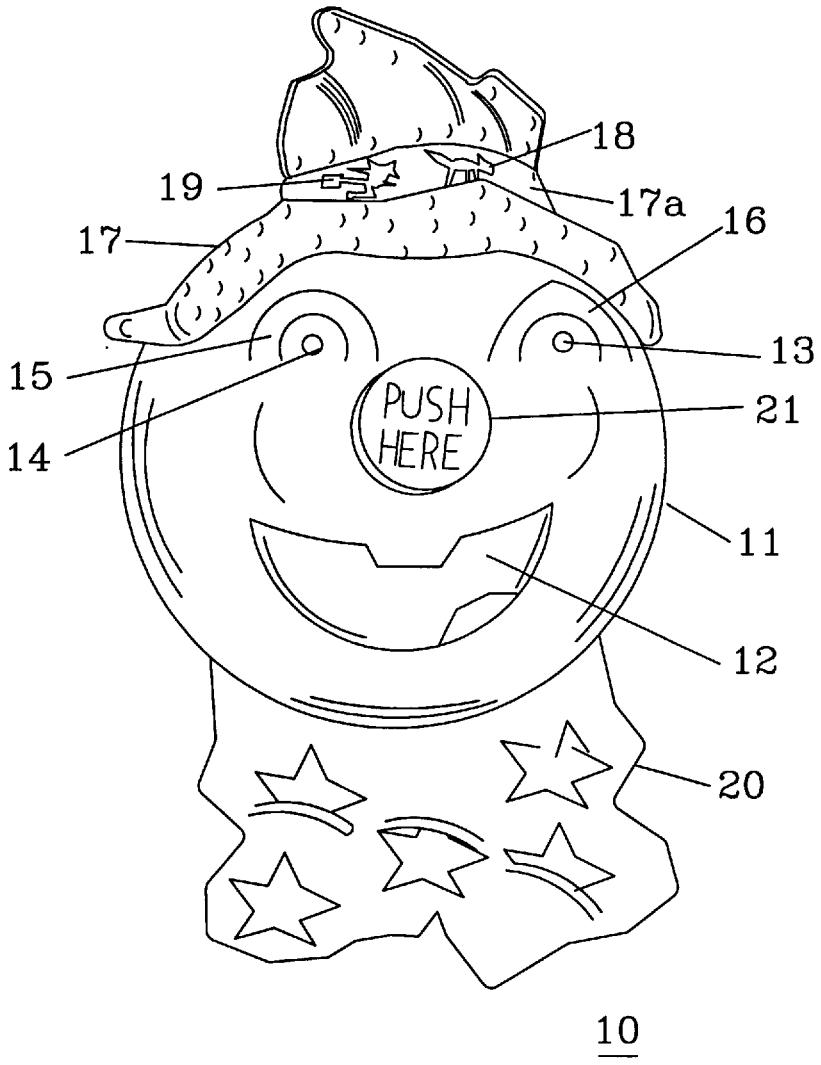
FIG. 1 shows a front view of an animated decorative door bell actuator that is mounted over an existing door bell button.

FIG. 1 shows one embodiment of the invention. The decorative door bell actuator 10 may be used in conjunction with a door bell or may be used in a stand alone configuration. Device 10 includes a central body portion 11 which may be in the form of a pumpkin with a hat 17 and a scarf 20. Pumpkin 11 has eyes 13 and 14, eye brows 15 and 16, and mouth 12. Eyes 13 and 14 may be LED lights which may produce a steady light, blinking light, or produce an output intensity in response to a sound volume level. Hat 17 has a hat band 17*a* with animated characters thereon such as animal 18 and witch 19. Nose 21 has the words PUSH HERE to indicate where to push to activate actuator 10 and any door bell button over which actuator 10 may be placed.

Figure 2:
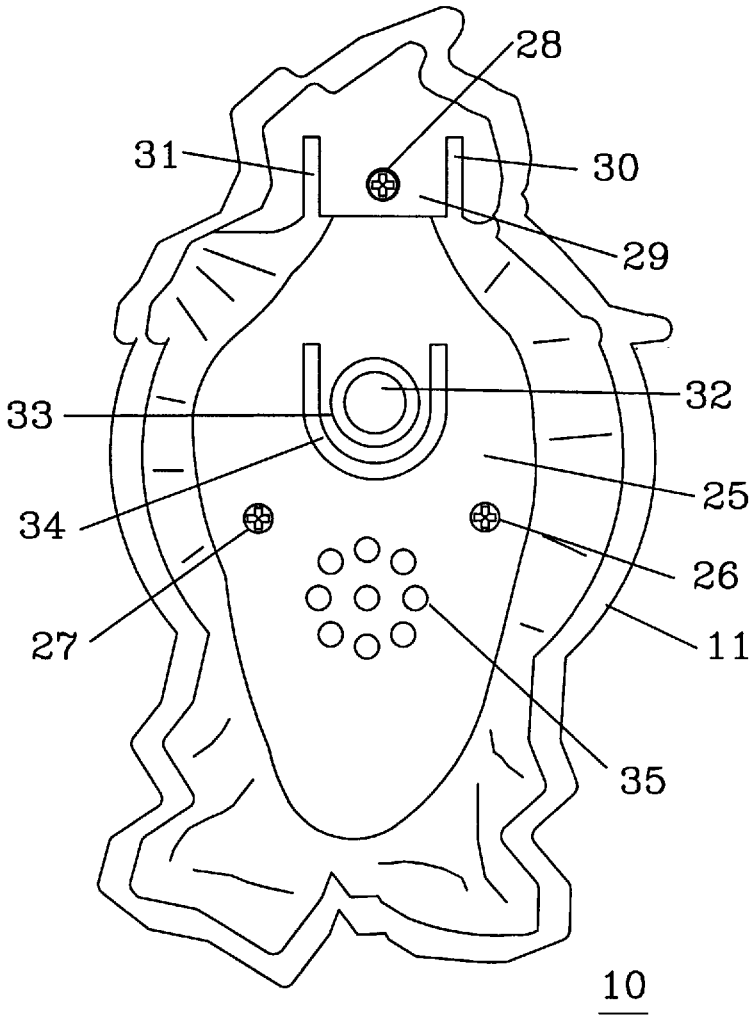
FIG. 2 is a back view of the decorative door bell actuator.
Figure 5:
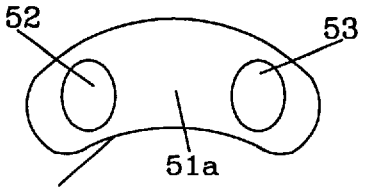
FIG. 5 is a front view of a mounting bracket for mounting a decorative door bell actuator over a door bell button.
Figure 6:
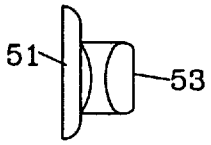
FIG. 6 is a side view of the mounting bracket of FIG. 5.
Figure 7:
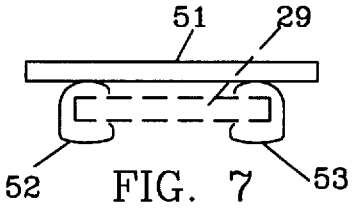
FIG. 7 is a top view of the mounting bracket.

FIG. 2 is a back view of actuator 10 showing a removable back panel 25. Back panel 25 is secured to actuator 10 by screws 26, 27 and 28. Openings 35 are used as a speaker grill for speaker 40 shown in FIG. 3. Panel 25 has a flexible tab 33 which can flex in opening 34. Mounted in tab 33 is push rod 32 described below with reference to FIG. 4. Mount tab 29, with slits 30 and 31, is used to mount actuator 10 on a mounting bracket (FIGS. 5, 6 and 7).

Figure 3:
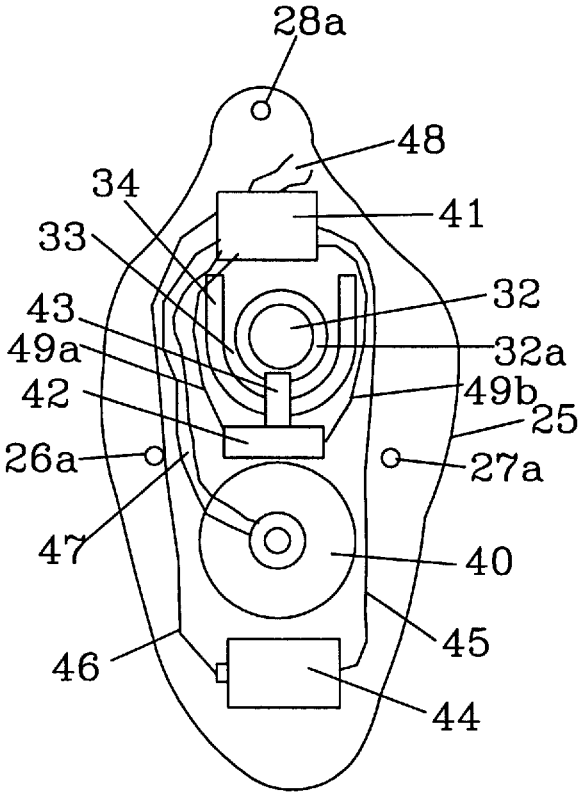
FIG. 3 shows a removable back panel of the decorative actuator.

FIG. 3 shows the inside side of back panel 25. To provide lights and sound for the actuator 10, control circuit 41 is powered by battery 44. Speaker 40 is connected to control circuit 41 by wire pair 47. LEDS are connected to control circuit 41 by wire pair 48. Switch 42 is connected to control circuit 41 via wires 49*a* and 49*b*. Wire 46 is connected between control circuit 41 and the positive terminal of battery 44. Negative power wire 45 is connected directly to control circuit 41.

Switch 42 is closed when actuated by contact arm 43 which is moved by tab 33 when pressure is applied to the "PUSH HERE" on the front of the actuator 10.

Back panel 25 has holes 26*a*, 27*a* and 28*a* through which screws 26, 27 and 28 (FIG. 2) pass to attach back panel 25 to pumpkin 11.

Figure 4:
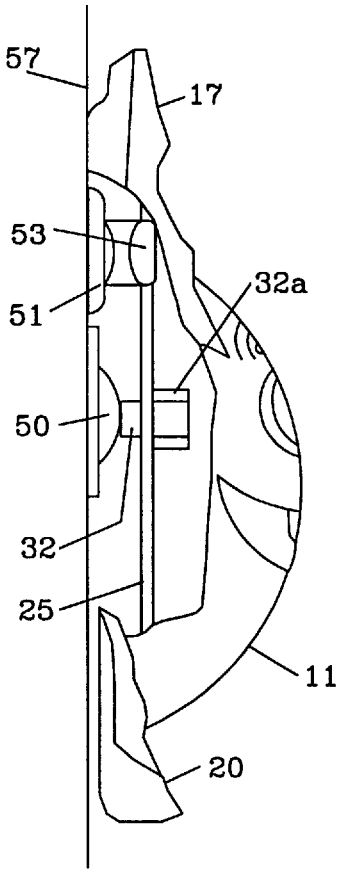
FIG. 4 shows a side view of the decorative actuator mounted over a door bell button.

FIG. 4. is a side view of actuator 10 with a part of it cut-away to show mounting and means for actuating a door bell button. Actuator 10 is mounted on wall 57 by mounting bracket 51 and mounting tab 29 (FIG. 2). Mounting tab 29 is placed in mounting fingers 52 and 53 which extend out from mounting bracket 51. Mounting fingers 52 and 53 extend into slits 30 and 31 as the actuator is placed above mounting bracket 51, and then lowered so that mounting tab 29 is moved into and between mounting fingers 52 and 53. When mounted, push rod 32 is positioned adjacent to door bell button 50. Push rod 32 is adjusted by screwing it in and out of mount 32*a* on back panel 25. Mounting tab 29 rocks or moves in bracket 51 so that when actuating device 10 is pressed on the PUSH HERE location, the entire body of actuator 10 will pivot or rock at its mounting point on mounting bracket 51, and push rod 32 will push door bell button 50, and will actuate switch 42 which actuates the various functions of control circuit 41 which may include sound, lights and motion control, for example by actuating a motor. Contact arm 43 is in contact with push rod mount 32*a* which is on flexible tab 33. When push rod 32 pushes on door bell button 50, or a mounting wall, if actuator 10 is not mounted over a door bell button, tab 33 flexes moving contact arm 43, closing switch 42.

FIGS. 5, 6 and 7, are front, side and top views of mounting bracket 51 which is used to mount actuator device 10 on a mounting surface. Mounting fingers 52 and 53 extend out from mounting bracket base 51*a*. Top view FIG. 7 shows mount tab 29 in dashed lines.

Figure 8:
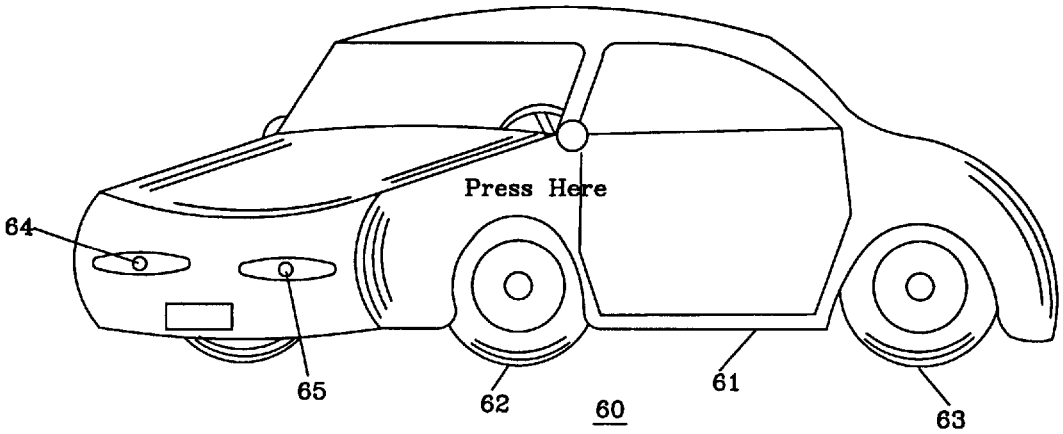
FIG. 8 shows a second embodiment of a decorative door bell actuator.

FIG. 8 shows a second embodiment of the invention wherein the actuator 60 is in the form of an automobile. Automobile 61 has two movable wheels 62 and 63. Wheels 62 and 63 may be mounted so that a motor (FIG. 9) rotates the wheels, or motion of the wheels may be supplied by such motion devices as a solenoid, a piezo electric element, or a nickel-titanium wire. Lights 64 and 65 may be LEDs that produce either steady light, blinking light, or produce an output intensity in response to a sound volume level. Actuator 60 may be mounted similarly to actuator 10 via a mounting plate on the back side of actuator 60.

Figure 9:
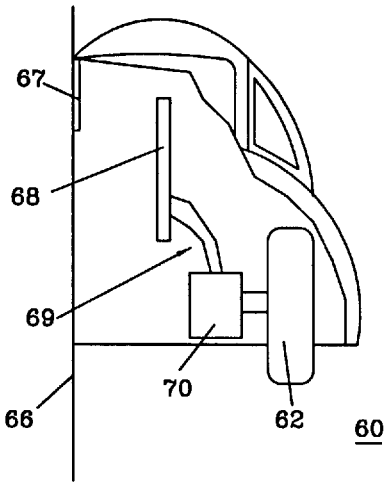
FIG. 9 is a side view of the embodiment of FIG. 8 in partial section.

In FIG. 9, the embodiment of FIG. 8 is shown in partial section showing actuator 60 mounted directly on surface 66 with flexible mounting tab 67. Control circuit board 68 is connected to motor 70 by wire pair 69. Motor 70 turns wheel 62 when motor 70 is actuated by control circuit 68.

Figure 10:
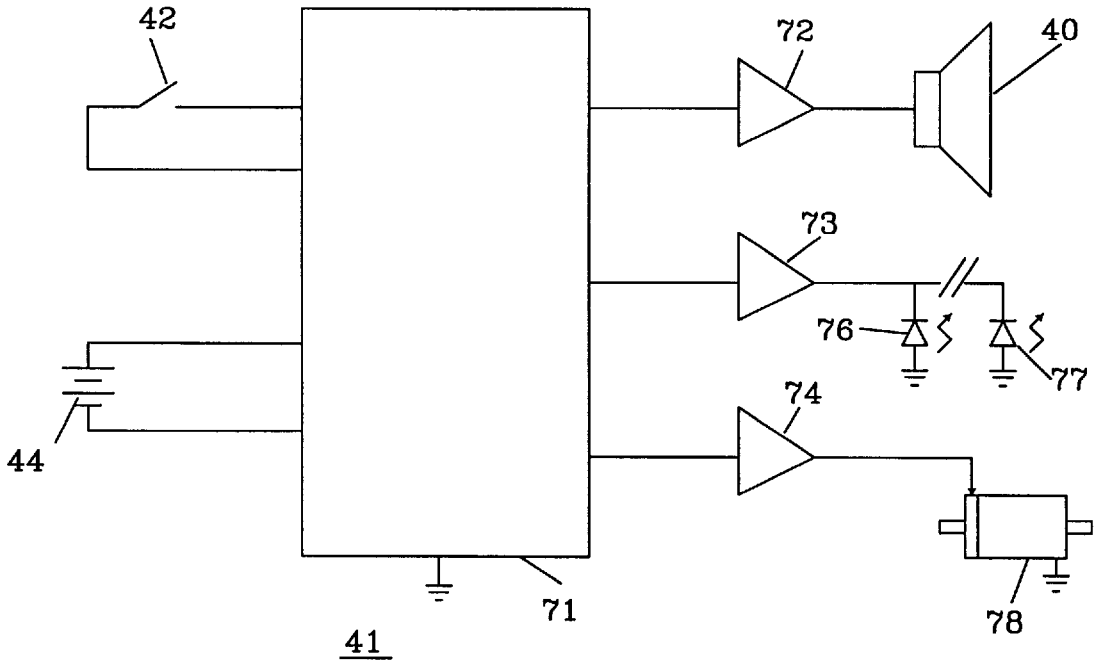
FIG. 10 shows an example of a control circuit used with the decorative door bell actuator.

FIG. 10 shows an embodiment of control circuit 41 and 68 which may include, for example, semiconductor integrated circuit 71. Integrated circuit 71 may be, for example, a Texas Instruments integrated circuit MSP50C32. Control circuit 71 provides control of the various functions of the control circuit such as sound, light control, motor control, etc. Circuit 71 is connected to switch 42 and battery 44 which supplies power to circuit 71. Also connected to circuit 71 is audio amplifier 72 and speaker 40 which provide the various sounds that may be associated with actuator 10. Driver 73 provides power to one or more LEDs such as LEDS 76 and 77. Driver 74 supplies power to motion actuator 78.

To use an actuator such as decorative actuator 10, mounting bracket 51 is attached to wall directly above a door bell button 50 with, for example, a two sided adhesive tape or other adhesive device. An alignment tool for use with the particular design of the actuator may be used to determine the correct height of a mounting bracket over the door bell. The actuator, which is a decorative door bell cover, is attached to the mounting bracket 51 (or directly to a mounting surface) over door bell button 50. The actuator pivots on mounting bracket 51 to allow rotation of the actuator toward and away from the door bell button 50. Push rod 32, which contacts the door bell button 50, is adjustable so to place push rod 32 in contact with door bell button 50. If the actuator is mounted on a wall that does not have a door bell, push rod 32 is adjusted to directly contact the wall, or mounting surface. Push rod 32 is adjusted by screwing it in or out of mount 32*a* so that when the actuator is pressed, the actuator pivots at mounting bracket 51 pushing push rod 32 against door bell button 50, ringing the door bell and closing switch 42 activating the electronics controlled by control circuit 41.

Control circuit 41 has a sleep mode that is interrupted when switch 42 is momentarily actuated. The sleep mode is activated after a predetermined period of time.

Bracket 51 is such that one decorative cover may be removed and another one of a different design mounted on bracket 51. Decorative actuator covers may include designs such as holidays, seasonal themes, animals, vehicles, sports and licensed animated characters, sports personalities, and special occasions such as birthdays, and bar mitzvah. The covers may be flat two dimensional designs, or three dimensional designs, and include a mounting area for a photograph or other object.

What is claimed:

1. A decorative actuator device for use in combination with a door bell button attached to a door bell, comprising:

a door bell button mounted on a surface;

a decorative actuator device body in the form of a theme object;

a mounting tab for attaching said actuator device to a surface over the door bell button;

a switch and electronic circuit within said decorative actuator device body, said electronic circuit for producing at least one of sound, lights and motion; and an adjustable member for actuating said switch and door bell button when the decorative body is moved toward the surface on which it is mounted.

2. The decorative actuator device according to claim 1, including a bracket, for use in conjunction with said mounting tab, for mounting on the surface over the door bell button.

3. The actuator device according to claim 1, wherein said adjustable member is adjustable in length to adjust for various mounting surfaces.

4. The actuator device according to claim 1, wherein said electronic circuit controls LEDS in at least one of steady light and blinking light states, and produces an output intensity in response to a sound volume level.

5. The actuator device according to claim 1, wherein said electronic circuit includes an audio output that produces sounds in the form of at least one of voice messages, music and animated sounds.

6. The actuator device according to claim 1, including a motion producing device controlled by said electronic circuit for producing at least one of motions that are rotational, linear and irregular.

7. The actuator device according to claim 1, wherein said electronic circuit includes a sleep mode that shuts down the electronic circuit after a predetermined period of time.

8. A decorative actuator device, for use in combination with a door bell button attached to a door bell comprising:

a decorative body in the form of a theme object;

a mounting tab for attaching said decorative body to a mounting surface over said door bell button;

a switch and electronic circuit within the decorative body for producing at least one of sound, light and motion; and an adjustable member extending from said decorative body for actuating said switch when the decorative body is moved toward the mounting surface engaging said door bell button.

9. The actuator device according to claim 8, wherein said adjustable member is adjustable in length to adjust for various mounting surfaces.

10. The actuator device according to claim 8, wherein said electronic circuit controls light LEDS in steady light and blinking light states, and produces an output intensity in response to a sound volume level.

11. The actuator device according to claim 8, wherein said electronic circuit includes an audio output that produces sounds in the form of at least one of voice messages, music and animated sounds.

12. The actuator device according to claim 8, including a motion producing device controlled by said electronic circuit for producing at least one of motions that are rotational, linear and irregular.

13. The actuator device according to claim 8, wherein said electronic circuit includes a sleep mode that shuts down the electronic circuit after a predetermined period of time.

* * * * *